United States Patent [19]

Davis

[11] Patent Number: 4,862,723

[45] Date of Patent: Sep. 5, 1989

[54] METHOD AND APPARATUS FOR PRODUCING PRECISE LENGTH DEVICES

[76] Inventor: Allen V. C. Davis, 5600 Alta Canyada, La Canada, Calif. 91011

[21] Appl. No.: 34,776

[22] Filed: Apr. 3, 1987

[51] Int. Cl.[4] ..... B21D 22/00

[52] U.S. Cl. ..... 72/352; 29/404; 29/445; 29/622

[58] Field of Search ..... 29/404, 445, 622, 157 R; 72/352, 367; 200/83 J

[56] References Cited

U.S. PATENT DOCUMENTS 1,655,156 1/1928 Muir ..... 72/352

4,669,182 6/1987 Ferroni ..... 29/622

*Primary Examiner*—P. W. Echols

*Attorney, Agent, or Firm*—John E. Wagner

[57] ABSTRACT

Method and apparatus are disclosed for producing pin operators for pressure switches in which the pin operator is adjusted in length while in a pressure environment with an associated diaphragm when subjected to proof pressure for the finished switch assembly. The pressure housing is preferably the actual switch housing. A die with a recess is aligned with the diaphragm and pin. The pin blank has an opening and tapered wall thickness. When proof pressure is applied to the opposite face of the diaphragm, the diaphragm forces the pin into the die recess to form the end of the pin and shorten its length. Thereafter the pin and diaphragm combination in the pressure housing will provide a prescribed travel when the diaphragm is subjected to proof pressure. An alternative device is disclosed for forming the ends of pins where proof pressure for the particular device is less than the required forming pressure for the pin. Semicylindrical, truncated conical and outwardly flared pin forms are disclosed. The alternate embodiment apparatus includes a body including an adjustable screw at one side and a dial indicator at the opposite side. A die is movable by the screw to deform a hollow end pin located in a pin receiver in the body. Deformation of the pin by advancement of the screw is measured by the dial indicator as compared to a reference length pin.

16 Claims, 3 Drawing Sheets

METHOD AND APPARATUS FOR PRODUCING PRECISE LENGTH DEVICES

BACKGROUND OF THE INVENTION

Those mechanical assemblies that necessarily must be constructed from discrete parts which operate through a wall and must be machined by succesive chucking operations often result in an excessive tolerance build-up. Reliable repetitive operation of pressure responsive devices through walls employing an operator and a negative rate spring, requires precise motion through the wall. The overall tolerance through the wall, the operator and the negative rate spring must be in the +/− one-one thousandths of an inch range.

In a pressure responsive device of this general type, a disc or belleville spring is positioned in a seat and deflected by a ring bearing on its inner edge. The ring is actuated by an operator through a wall which is in turn actuated by pressure bearing on a diaphragm resting on a plate. The operator is a pin which moves in a direction which is normal to the plane of the disc. The total travel of the disc spring in this assembly must be precisely established in assembly to match the force-deflection spring characteristics of the disc spring for the operating pressures expected up to the proof pressure.

In the past, the precise control of the operator's travel was dependent upon either shimming of or machine trimming parts in assembly. The tolerances provided by state of the art CNC machines because of the several chuckings required were invariably excessive in the final assembly. Another travel variable was introduced by the forming of parts from sheet metal which necessarily had its grain warpage running at right angles to the direction of travel. It would be far superior if the disc or spring and operator pin were fabricated to matched dimensions and assembled into non repairable assemblies with predictable characteristics for their operating lifetime.

BRIEF DESCRIPTION OF THE INVENTION

I face this perennial problem in pressure responsive devices obtaining precise travel through a wall member separating a pressure chamber and a disc spring support. The problem was explored from the standpoint of devising an operator element which would simultaneously provide (a) a precise length, (b) a self-aligning quality to accommodate the asymmetric form of the disc at the area of contact with the pin due to its across-the-grain forming, (c) facilitate calibration of the pin travel with proof or greater pressure applied, and point contact so as to not inhibit the asymmetric displacement characteristics of this disc spring under load. To accomplish the above in an actual assembly of spring and operator used together in a finished pressure switch is desirable.

The solution to provide this combination of features would appear to lie in utilizing the operator pin in the form of a deformable hollow tube member which is deformed to the precise length required, after machining. However, the deformation required to accomplish the precise length control needed against the wall member caused this hollow tube's diameter to deform as well. A suitable operator was found to be dependent upon limiting the wall thickness of the hollow formable end and holding its depth to less than the seat depth in which it was housed in its mating part or progressively thickening its wall section to preclude bulging and axial distortion. The end shape could be spherical, tapered or flared, but in every instance, if the hollow wall was not plastically deformed at proof or greater pressure or its depth substantially exceeded the depth of its mating seat or was not tapered, the tubular portion below this depth would deform outward in a bead fashion when the end was deformed as described. This would result in a functional interference or seizing within the housing wall in which it must slidably operate to render the operator functionally operative.

The hollow end of the operator pin is fabricated to slightly longer than the length required. The first end, the one which is to engage the disc spring actuator, is formed with the described thin wall constraints. The opposite end is commonly flat. The length of the operator pin must be sufficiently greater than the wall thickness of the hollow end in order to secure the precise travel required. Setting the length by the described deformation may be accomplished in one of two ways:P the operator can be deformed in a fixture to the desired length, or in a preferred form of the embodiments to deform the operator to its precise length while in the actual switch assembly itself.

After forming, the operator pin is next placed in a pressure housing which is the body of the switch in which the pin will be assembled. The pin is positioned with the hollow end resting in a forming die which corresponds in shape and depth to the recess of the mating actuator switch with which the operator pin will mate in the finished assembly.

A diaphragm of the actual switch actuator which bears a pressure plate forces the operator pin to deform to the desired length with the proof or greater pressure applied to the pressure port of the switch actuator. Proof pressure for the intended device is often 1000 psi or greater applied to the opposite side of the diaphragm through the pressure port in the actuator body or housing. Deflection loading of the diaphragm under proof or greater pressure causes the total force to be applied to the hollow end of the operator pin causing it to be deformed to the length and as shape determined by the setting die. Plastic deformation of the hollow end produces a shape conforming to the setting die recess. In any event, deflection of the diaphragm and deformation of the operator pin ceases when the pressure plate under the diaphragm comes in contact with an annular stop. Normal deformation of the operator pin under proof pressure does not cause sufficient shortening of the operator pin for the pressure plate to reach the annular stop. The operator pin is given the precise length required by the setting die's dimensions. Accuracies within +/−0.001 may be achieved employing this invention.

The preferred form of the apparatus for carrying out this invention comprises a pressure housing for a switch actuator having an inlet pressure port and a threaded opening at the opposite end for temporarily receiving the die assembly in the location normally occupied by an electrical switch in the finished product. The die is located on a central post which also supports the wall plate which threadably engages the housing and is sealed at the periphery by an "O" ring seal. The wall plate defines an annular stop for the pressure plate on which the diaphragm, in turn, bears and limits deformation of the pin's hollow end to the desired length during the forming process.

An alternate embodiment of this invention employs externally applied force to provide the deforming force for the hollow pins. The external force is applied in its simplest form by a screw adjustment of the die against the restrained hollow pin. A reference pin is used along with a dial indicator to indicate deformation to the reference length.

BRIEF DESCRIPTION OF THE DRAWING

This invention may be more clearly understood from the following detailed description and by reference to the drawing in which.

DETAILED DESCRIPTION OF THIS INVENTION

Figure 1:
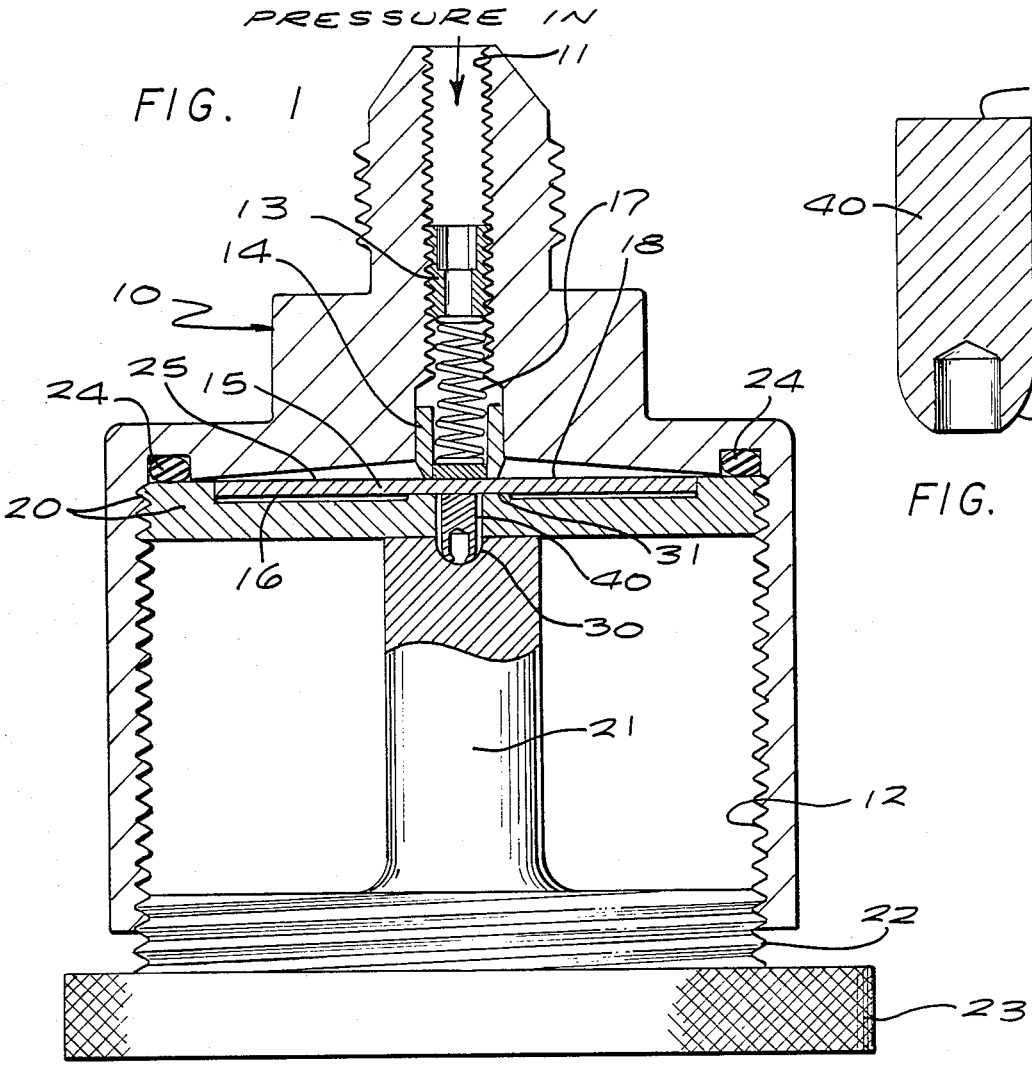
FIG. 1 is a vertical sectional view through the apparatus of this invention employed in carrying out the preferred method of this invention.

Now referring to FIG. 1, the apparatus employed in carrying out this invention is illustrated therein as including a pressure housing 10 having an inlet pressure port 11 at one end thereof, and a threaded opening 12 at the opposite end. This housing is preferably the body of a switch actuator. The pressure port 11 includes a threaded spring adjusting sleeve 13 bearing on an adjustment spring 17. The spring 17 seats in a spring shoe member 14 which rests against the upper face of a diaphragm 18 bearing against a pressure plate 15. A removable temporary wall plate 20 rests on a central die column 21 supported by base 22. The base 22 is enlarged to engage the internal threads in the housing 10. An external knurled handle 23 allows the post 21 to be advanced into the housing 10 into engagement with wall plate 20 which is sealed with "O" ring 24 to provide a pressure chamber 25 above the diaphragm 18 corresponding to the pressure chamber of the finished switch actuator. The upper surface of wall plate 20 surrounding the central opening therethrough includes an annular stop 31 which limits downward movement of the diaphragm 18 and limits the deformation of the operator pin. Stop 31 is surrounded by clearance space 16.

Figure 2:
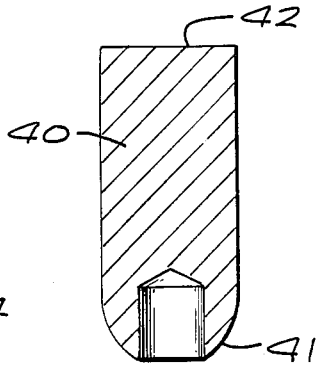
FIG. 2 is a vertical sectional view of a partially fabricated operator pin ready for deformation forming through the use of this invention.
Figure 3:
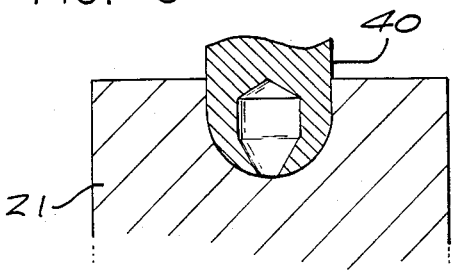
FIG. 3 is a fragmentary vertical sectional view of the formed end of pin of FIG. 2.

In use, the knurled handle 23 is unthreaded removing column 21. An operator pin 40 of the form shown in FIG. 2 is placed in the wall plate opening with the hollow end 41 downward. The threaded handle 23 threadably engages housing 10 with the die column 21 positioning the operator pin 40 with the hollow end 41 in engagement with the die recess 30. Next, proof pressure, e.g. 1000 psi, is supplied to the pressure inlet 11 causing the diaphragm 18 and pressure plate 15 to move downward deforming the edge 41 of the first end of the operator pin 40 inward to the form as shown in FIG. 3. The operator pin 40 has been shortened and its first end shape formed to conform to the die recess 30 in the column 21.

The threaded handle 23 is then disassembled and the completed operator pin 40 remains. The housing 10, diaphragm 18, pressure plate 15 and fabricated pin 40 are then ready to complete assembly into a pressure switch with the addition of an electrical switch within the housing 10 in position to be actuated by the operator pin 40.

The preferred embodiment of a semi-spherical shape is illustrated in FIGS. 1, 2, and 3 since a spherical shape is preferred being the most self-aligning embodiment of the invention. Such a shape is not always required however, provided that the operator pin is deformed to conform in length as determined by the depth of the die recess 30 and shape as the inverse of the shape of the recess 30. Likewise, the formation need not be by the converging or crimping inward of the operator end 41. Two variations are illustrated in FIGS. 4 and 5.

Figure 4:
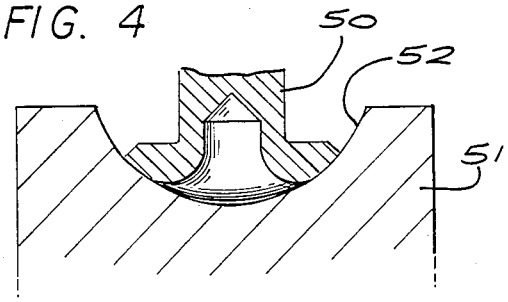
FIG. 4 is a fragmentary vertical sectional view of an alternate embodiment of pin and die showing an outward flared pin end produced employing this invention.

In FIG. 4, the die 51 includes a sector of a sphere recess 52 and the operator pin 50 is of significantly smaller diameter than the recess 52. Prior to formation by this die, the end of tube 50 must be slightly flared and then when proof pressure is applied in the apparatus of FIG. 1 with a modified die 51, the tube 50 will flare outward into the configuration shown in FIG. 4. Again, the finished length of the operator pin 50 between the engaging surface **50*a* and shape of the engaging surface 50*a* of the operator 50 will match that of the die 51** under a selected proof pressure or above.

Figure 5:
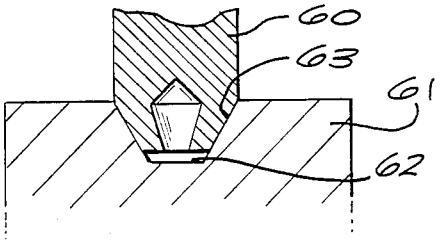
FIG. 5 is a fragmentary vertical sectional view of a second alternate embodiment of pin and die of a truncated conical shape and tapered wall.

In FIG. 5, the die 61 includes a truncated conical opening 62 and the operator pin 60 shown with a tapered wall section is formed inward into a frusto-conical shape on surface 63.

Figure 6:
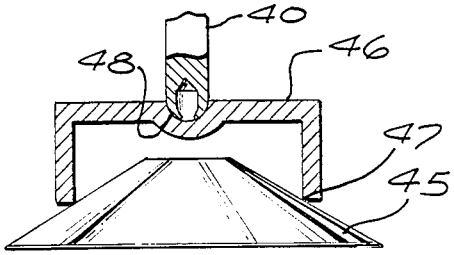
FIG. 6 is a side elevational view, partly in section, of this invention as applied to a pressure switch assembly employing an actuator member between the disc spring and the operator pin employed in this invention.

FIG. 6 illustrates that often the recess which mates with the operator pin 40 engages a spring register member 46 having its rim portion engaging the spring disc 45. The spring register 46 includes its semi-spherical recess 48 in the center portion matching the die 30 form of FIG. 1.

Figure 7:
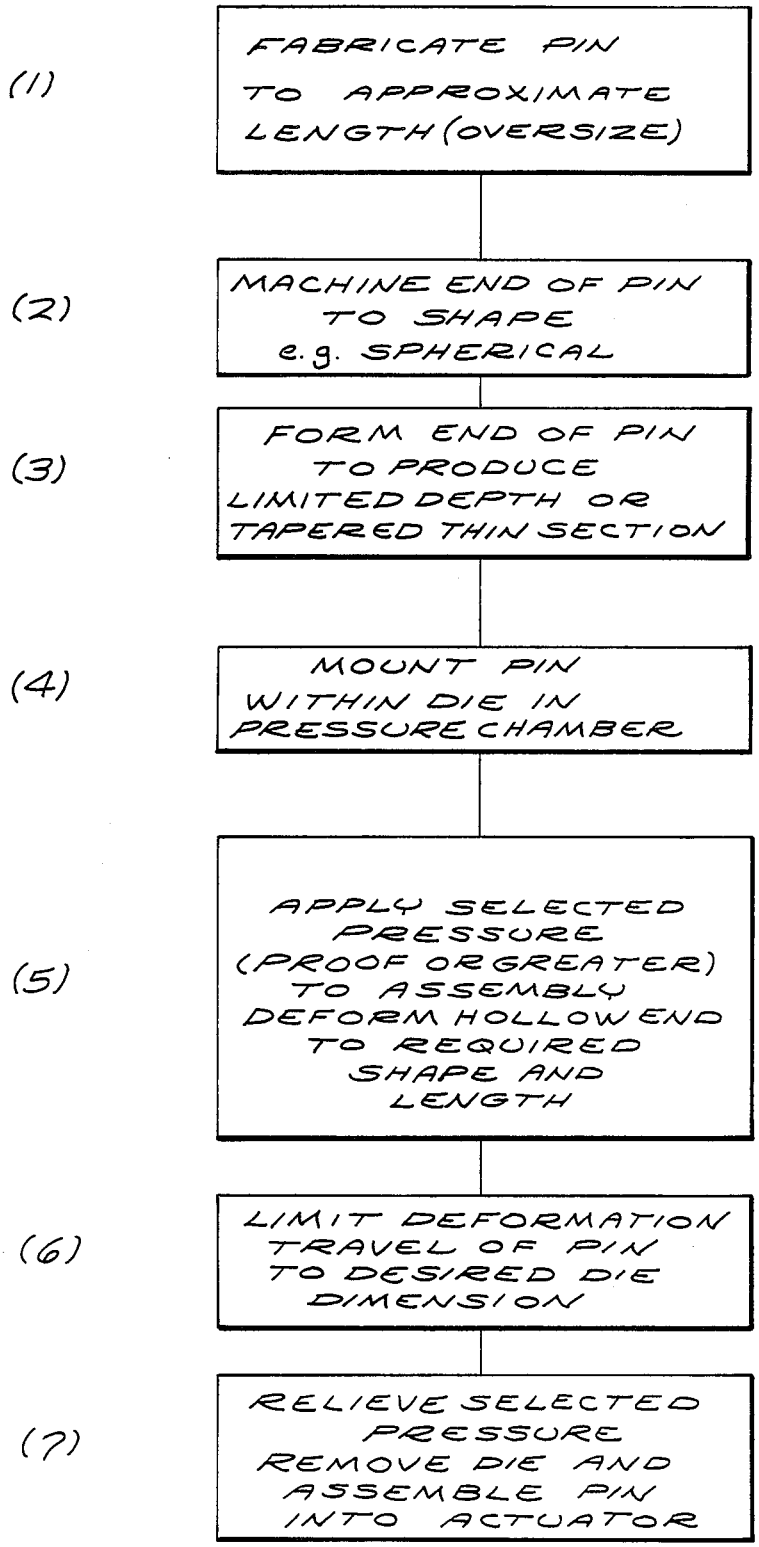
FIG. 7 is a flow diagram of the preferred method of accomplishing this invention.

Regardless of which form of operator pin desired, precise length, precise shape, operator pins are produced. The process of this invention is summarized in the flow diagram of FIG. 7.

In this process the second and third steps may be reversed in order without affecting the overall results.

Figure 8:
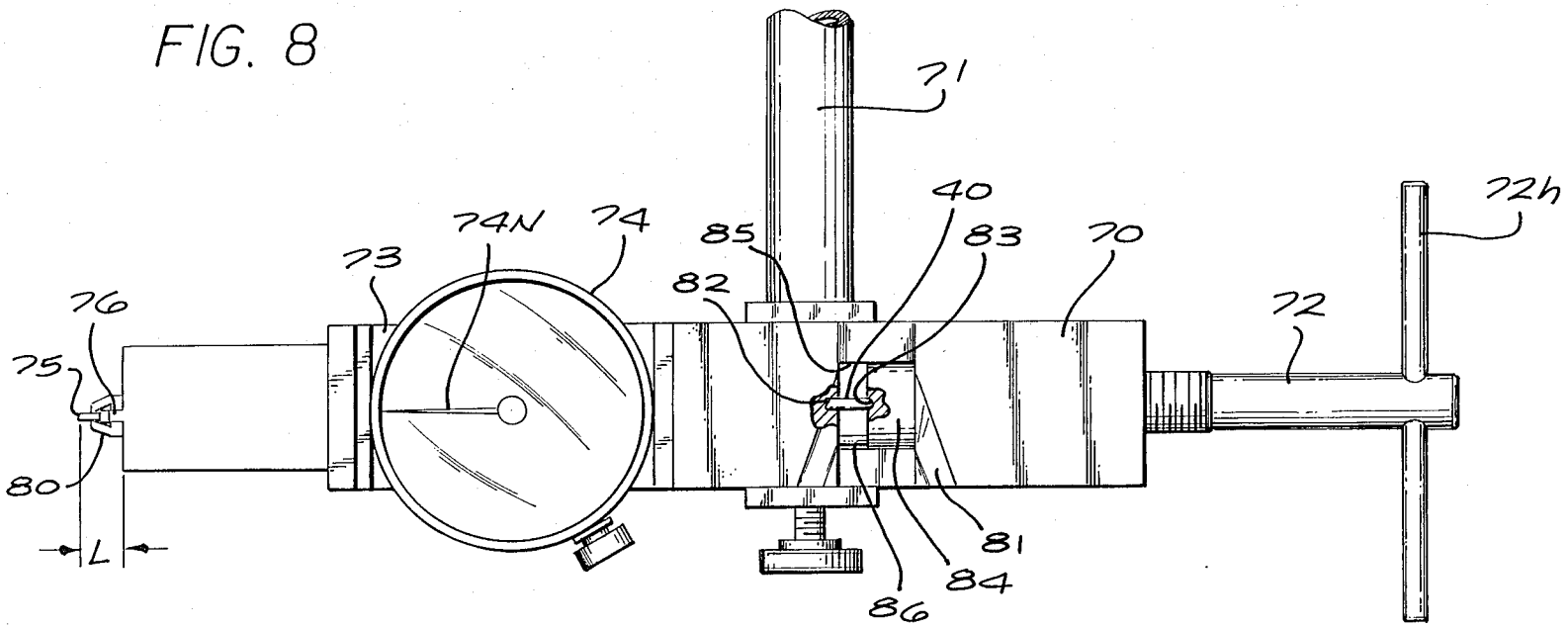
FIG. 8 is a front elevation view, partly broken away, of an alternate embodiment of this invention employing externally applied pressure for pin deformation.
Figure 9:
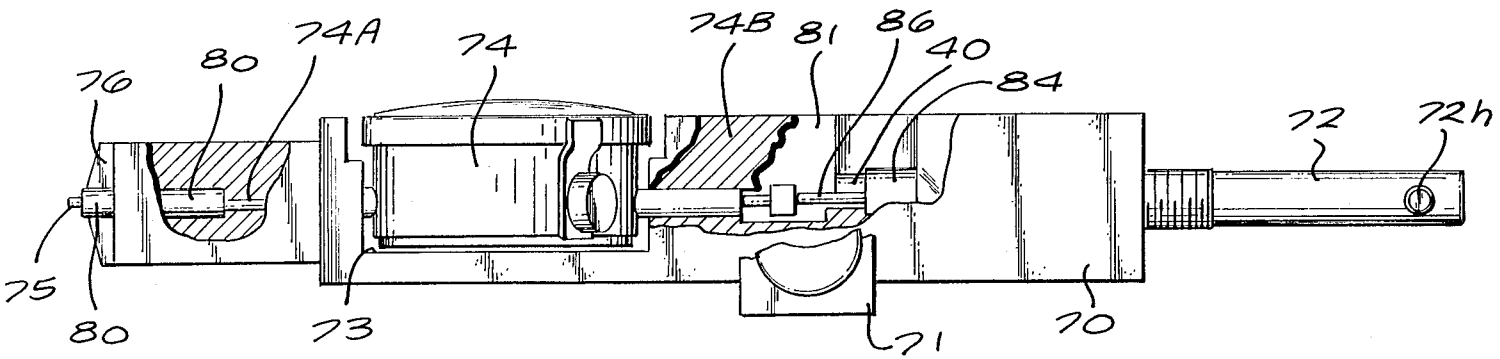
FIG. 9 is a side elevational view thereof partly broken away.

In certain cases where the proof pressure for a switch is lower than a practical forming pressure for the pin 40, I have devised apparatus which employs external mechanical pressure rather than fluid pressure to form the pin 40. Such apparatus is illustrated in FIGS. 8 and 9. It comprises a body 70 having a removable side handle 71 and an adjustment screw 72 both held by the operator during pin length formation. A recess 73 provides a receptacle for a dial indicator 74. At the end opposite the adjusting screw 72 is a reference pin 75. A plunger 80 is coupled to dial indicator 74 to move the indicator needle 74N.

At the opposite side of the dial indicator 74 from the plunger 80 is a pin receiver 81 similar to the receiver of a firearm. A pin holding recess 82 in the body 70 supports the unbored end of pin 40 opposite the die recess 83 in the end of die 84 driven by screw 72 whenever its handle 72H is turned.

A pair of pins 85 and 86 are driven by die 84 and engage the opposite end 74B of the indicator 74. The indicator 74A engages the plunger 80. Inward movement of plunger 80 to the right in the drawing causes the indicator needle 74N to move in one direction. Inward movement of pins 85 and 86 reflecting position of die 84 causes movement of pin 74B in the opposite direction. When an operator pin 40 is in place, and the indicator zeroed out by action of screw 72, the pin 40 is deformed to a reference length L of FIG. 8 plus the required travel specified for finished actuator.

This apparatus of FIGS. 8 and 9 is used to produce formed operator pins to a reference standard using only hand pressure. This is particularly useful for small pins 40 and those designed for proof pressure too low to provide forming pressure as in the apparatus of FIG. 1.

This invention shall not be limited to the illustrative embodiment but rather to the claims as set forth below which constitute definitions of this invention including the protection afforded by the doctrine of equivalents.

What is claimed is:

1. The method for producing a precise length operator pin for use in a pressure responsive assembly employing a deflectable disc spring within a pressure housing and actuated by engagement of a mating central recess in said deflectable disc spring with an operator pin engaging a pressure plate and diaphragm to produce a specified movement of the operator pin as a function of the disc spring's force deflection characteristics, responsive to pressure at or below a predetermined proof pressure, comprising:

producing an operator pin having a nominal length sufficient to provide with said disc, an overall length slightly greater than the required overall length for the combination of disc and operator pin under a selected proof pressure greater than intended operating pressure within a pressure housing;

forming the first end of the pin to conform generally to the shape of the central recess in the disc;

producing an end opening in said first end of the pin to provide a hollow end of limited depth or taper;

positioning said pin in a pressure housing within a die having the configuration of the recess in said disc while restraining said pin from movement;

applying selected pressure greater than the intended operating pressure to the end of said pin opposite said hollow opening, said selected pressure being in the order of the proof pressure for the pressure responsive assembly and sufficient to deform the hollow end of said pin to the precise length associated with said proof pressure; and releasing the selected pressure;

whereby the end of said operating pin, which is positionable adjacent to said disc is deformed to conform to the shape of said recess in said disc and the operator pin is deformed to a length consistent with the required travel which is dictated by the force deflection characteristics of the particular disc spring.

2. The method in accordance with claim 1, wherein the first end of said operator pin is bored from the end thereof to provide a thin edge region of said operator pin.

3. The method in accordance with claim 1, wherein said recess in said disc spring actuator is formed generally in a semi-spherical shape for engagement with the formed end of said pin.

4. The method in accordance with claim 3, wherein said pressure housing includes a port for the introduction of proof or greater pressure into said pressure housing through said port and urging the hollow end of said operator pin into said semi-spherical recessed die and wherein said method includes the step of applying proof or greater pressure to the second end of said pin while the first end thereof is located in the semi-spherical recess in said die.

5. The process in accordance with claim 4, wherein said die has a semi-spherical recess of diameter greater than the diameter of said operator pin;

wherein the method includes the step of flaring the first end of said pin outward and wherein said operator pin is deformed to precise length and semi-spherical end includes an outward flared end.

6. The method in accordance with claim 1, wherein the recess in the disc is generally conical and said pin has a generally planar bored end and wherein said method includes the step of inwardly deforming said first end of said pin into a generally frusto-conical shape.

7. The method for producing a precise length operator pin for use in a pressure responsive assembly in accordance with claim 1, wherein the applied selected pressure means to provide deformation of said hollow opening is applied externally to the assembly;

wherein flow of said pin material resulting from deformation is governed by said pressure housing wall plate thickness and the travel dictated by the disc spring's force deflection characteristics.

8. Apparatus for producing precise length elongated members having a thin walled end for use in a pressure housing to transmit motion responsive to pressure applied to said housing comprising:

a pressure housing having a pressure inlet port therein;

a closure for said housing;

die means within said pressure housing including a recess;

means positioning an elongated member having a thin walled end adjacent to said die means recess;

and means for applying a selected pressure to said pressure housing and to said elongated member to drive said thin wall end of said elongated member into deformation by said die to a precise length which is a function of said selected pressure and to conform the thin wall end of said elongated member to the shape of the said recess.

9. Apparatus in accordance with claim 8, wherein said means for applying selective pressure includes a diaphragm in sealed engagement within said housing and in pressure applying relationship with the end of said elongated member opposite the thin walled end thereof.

10. Apparatus in accordance with claim 8, wherein said die means constitutes a column in a openable wall of said pressure housing.

11. The combination in accordance with claim 8, wherein said means for applying selected pressure to said elongated member includes a plate encircling said die means and defining said pressure chamber.

12. Apparatus in accordance with claim 11, wherein said plate includes an opening therethrough in the region of said recess to allow deforming movement of an elongated member located in said opening responsive to applied selected pressure.

13. Apparatus in accordance with claim 11, wherein said plate includes stop means for limiting the amount of deformation of the elongated member.

14. Apparatus in accordance with claim 13, wherein said plate includes an opening therethrough in the region of said recess and said stop means comprises an annular boss encircling said opening and the elongated member to be formed.

15. The apparatus in accordance with claim 8 wherein said pressure housing is the actual pressure housing in which said elongated member after deformation is to operate.

16. The apparatus in accordance with claim 8 wherein said means for applying selected pressure includes an actual diaphragm with which said elongated member, after deformation, is to operate.

* * * * *